US005250133A

United States Patent [19]

Kawamura et al.

[11] Patent Number: 5,250,133

[45] Date of Patent: Oct. 5, 1993

[54] METHOD FOR RECORDING IMAGES AND APPARATUS FOR RECORDING IMAGES

[75] Inventors: Tomonori Kawamura; Kunihiro Koshizuka, both of Hino, Japan

[73] Assignee: Konica Corporation, Tokyo, Japan

[21] Appl. No.: 861,901

[22] Filed: Apr. 1, 1992

[30] Foreign Application Priority Data

Nov. 1, 1991 [JP] Japan ..... 3-288089

[51] Int. Cl.[5] ..... B44C 1/00

[52] U.S. Cl. ..... 156/240; 156/230; 156/361; 156/182; 156/277; 283/77; 428/913

[58] Field of Search ..... 283/107, 904, 75, 109, 283/77; 156/540, 541, 277, 234, 235, 240, 555; 40/368; 346/76 PH; 400/120, 241.4

[56] References Cited

U.S. PATENT DOCUMENTS

| | | | |
|---|---|---|---|
| 4,728,386 | 3/1988 | Horvath | 156/361 X |
| 4,837,199 | 6/1989 | Morishita | 428/195 X |
| 4,880,768 | 11/1989 | Mochizuki | 503/227 X |
| 4,890,120 | 12/1989 | Sasaki | 346/76 PH |
| 4,965,242 | 10/1990 | Deboer | 156/277 X |
| 5,011,570 | 4/1991 | Ohbayashi | 156/182 X |
| 5,019,550 | 5/1991 | Suzuki | 428/195 X |
| 5,080,463 | 1/1992 | Faykish | 428/204 X |
| 5,106,719 | 4/1992 | Oshikosmi | 283/77 X |
| 5,114,904 | 5/1992 | Kawakami | 428/913 X |
| 5,116,148 | 5/1992 | Ohara | 428/913 X |

FOREIGN PATENT DOCUMENTS

| | | |
|---|---|---|
| 58-188695 | 11/1983 | Japan . |
| 59-78893 | 5/1984 | Japan . |
| 59-78896 | 5/1984 | Japan . |
| 59-106997 | 6/1984 | Japan . |
| 59-109349 | 6/1984 | Japan . |
| 59-158287 | 9/1984 | Japan . |
| 59-182785 | 10/1984 | Japan . |
| 59-196292 | 11/1984 | Japan . |
| 59-227948 | 12/1984 | Japan . |
| 60-24966 | 2/1985 | Japan . |
| 60-27594 | 2/1985 | Japan . |
| 60-30392 | 2/1985 | Japan . |
| 60-30394 | 2/1985 | Japan . |
| 60-31560 | 2/1985 | Japan . |
| 60-53563 | 3/1985 | Japan . |
| 60-53565 | 3/1985 | Japan . |
| 60-130735 | 7/1985 | Japan . |
| 60-131292 | 7/1985 | Japan . |
| 60-239289 | 11/1985 | Japan . |
| 60-253595 | 12/1985 | Japan . |
| 61-12394 | 1/1986 | Japan . |
| 61-19396 | 1/1986 | Japan . |
| 61-22993 | 1/1986 | Japan . |
| 61-31292 | 2/1986 | Japan . |
| 61-31467 | 2/1986 | Japan . |
| 61-35994 | 2/1986 | Japan . |
| 61-49893 | 3/1986 | Japan . |

(List continued on next page.)

*Primary Examiner*—David A. Simmons
*Assistant Examiner*—Charles Rainwater
*Attorney, Agent, or Firm*—Frishauf, Holtz, Goodman & Woodward

[57] ABSTRACT

An image forming method using a thermal transfer processes and an apparatus used in the method are disclosed. The images were formed on the image receiving layer of a image recording body and includes a gradation information-containing image formed by means of a thermal sublimation transfer method and a character information-containing image formed by means of a thermal fusion transfer method. A trans parent protective layer is transferred from a protective forming thermal transfer sheet to the surface of image receiving layer so as to cover the whole area of the image receiving layer by a hot stamping means. The hot stamping means has a heating roll which has a contacting length longer than the width of said image receiving layer and a peripheral length longer than the length of said image receiving layer.

11 Claims, 8 Drawing Sheets

FOREIGN PATENT DOCUMENTS

| | | |
|---|---|---|
| 61-148269 | 7/1986 | Japan . |
| 61-262190 | 11/1986 | Japan . |
| 61-283595 | 12/1986 | Japan . |
| 62-169694 | 7/1987 | Japan . |
| 62-191191 | 8/1987 | Japan . |
| 62-229594 | 10/1987 | Japan . |
| 62-244696 | 10/1987 | Japan . |
| 63-5992 | 1/1988 | Japan . |
| 63-74686 | 4/1988 | Japan . |
| 63-91287 | 4/1988 | Japan . |
| 63-91288 | 4/1988 | Japan . |
| 63-122594 | 5/1988 | Japan . |
| 63-122596 | 5/1988 | Japan . |
| 63-145089 | 6/1988 | Japan . |
| 63-193886 | 8/1988 | Japan . |
| 63-205288 | 8/1988 | Japan . |
| 63-290793 | 11/1988 | Japan . |
| 64-159 | 1/1989 | Japan . |
| 64-63194 | 3/1989 | Japan . |
| 1-127387 | 5/1989 | Japan . |
| 1-204788 | 8/1989 | Japan . |

METHOD FOR RECORDING IMAGES AND APPARATUS FOR RECORDING IMAGES

FIELD OF THE INVENTION

The present invention relates to a method for recording images and an image recording apparatus using therefor, more particularly to a method for recording images which is excellent in colorant fixing property, capable of forming uniformly a protective layer of fine appearance on the whole surface of an image receiving layer on which images are formed, and free from thermal deformation or curling of a recording material, and an image recording apparatus using therefor.

BACKGROUND OF THE INVENTION

A variety of image recording bodies are used as so-called ID cards including identification cards themselves, driving licenses and membership cards. In general, ID cards contain a portrait to identify the bearer of the card and various mentioned items. This portrait is usually made of a gradation image; therefore, it is called a gradation information containing image hereinafter simply referred to as a gradation image. The various mentioned items of an identification card include, for example, the bearer's place of residence, name, date of birth, position and the expiration date of the card's validity time, and those of a driving license are the bearer's name, date of birth, license number and type of license. These mentioned items are usually described by use of letters, figures or symbols; accordingly, these are called character information containing images hereinafter simply referred to as a character image.

Recently, there has come to be used ID cards carrying a gradation image formed by the sublimation thermal transfer method, because of the method's capability of forming fine images with ease. In general, the sublimation thermal transfer method means a method of forming a gradation image, such as a portrait, on an image receiving layer by the steps of contacting the image receiving layer of an image receiving sheet, which comprises a support and the image receiving layer provided thereon, with an ink layer of an ink sheet, which comprises a support and the ink layer containing a sublimation dye provided thereon, and transferring the sublimation dye onto the image receiving layer by imagewise heating.

However, this sublimation thermal transfer method is not necessarily satisfactory in dye fixation and liable to cause set-off or blur of image dyes.

In order to improve the fixation of dyes and protect the gradation image on ID cards, there has been practiced the transfer of a protective layer onto the surface of an ID card by means of hot stamping method.

But such a protective layer covers only image portions, which project from non-image portions and tend to retain residual resins called burrs on their periphery, thereby such a covering often impairs appearance of a card. Further, an unevenly applied heat in hot stamping is liable to cause thermal deformation or curling.

SUMMARY OF THE INVENTION

The object of the invention is to provide a method of recording images and an image recording apparatus free from problems involving appearance, thermal deformation, sticking and curling of image recording bodies, by means of an improved hot stamping apparatus which forms a protective layer on the whole surface of an image receiving layer on which images are formed.

The above object of the invention can be achieved by an image recording method comprising steps of forming a gradation image on an image receiving layer of an image recording body by means of a thermal sublimation image transfer method, forming a character image on the image recording layer by means of a thermal sublimation image transfer method or a thermal fusion image transfer method, and then transferring a transparent protective layer from a protective layer forming thermal transfer sheet on the surface of the image receiving layer by a hot stamping means having a heating roll so as to cover the whole area of the surface of the image receiving layer, wherein the heating roll has a contacting length longer than the width of the image receiving layer and a peripheral length longer than the length of the image receiving layer.

And an image recording apparatus comprising a first heating means for imagewise heating a thermal sublimation transfer ink sheet, which is contacted with the image receiving layer of a image receiving sheet, to form a gradation image on the surface of the image receiving layer, a second heating means for imagewise heating a thermal fusion image transfer sheet or a thermal sublimation image transfer sheet, which is contacted with the image receiving layer, to form character image on the surface of the image receiving layer, and a hot stamping means having a heating roll for transferring a transparent protective layer by heating with pressure from a protective layer forming thermal transfer sheet to the surface of the image layer, which is receiving layer caring the gradation image and the character image, so as to cover the whole area of the surface of the image receiving layer, wherein the heating roll has a contacting length longer than the width of the image receiving layer and a peripheral length longer than the image receiving layer

DETAILED DESCRIPTION OF THE INVENTION

I. Method for Recording Images

A. Substrate of Recording Body

Figure 1:
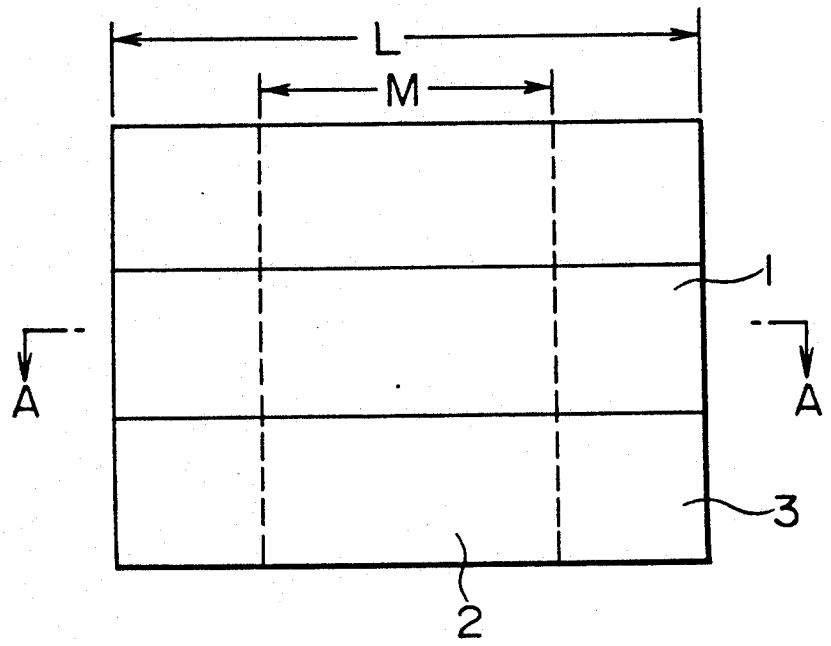
FIG. 1 is a top view illustrating use of the heating roll of the hot stamping apparatus employed in the invention.

Substrate used in the invention are not particularly limited, as long as these are capable of forming, in the manufacture of image recording bodies, at least both of gradation images by the sublimation thermal transfer method and character images by the fusion thermal transfer method or sublimation thermal transfer method, and as long as these have mechanical strengths, such as strength and stiffness, large enough to be used as card.

In order to maintain a mechanical strength as card, there may be used a substrate formed by laminating sheets made of the same or different materials. There may also be used, as an observable layer, a substrate printed with information common to other cards of the same type. Further, use is made of a substrate subjected to a forgery preventive processing to provide a physically identifiable means such as watermark, for the purpose of preventing forgery or alteration of a card itself.

The general structure of the substrate is that which comprises a support and an image receiving layer laminated thereon. In this case, the image receiving layer may be provided on one side or both sides of the support, or only on a desired portion.

With respect to the image receiving layer to form gradation images and character images, there may be provided separately, on a support, the first image receiving layer prepared to receive heat-diffusible dyes fully and the second image receiving layer prepared to adhere to heat-fusible inks fully.

In another embodiment of the substrate according to the invention, the substrate may be comprised of only a support which receives no heat-diffusible dyes but adheres to heat-fusible inks fully.

In forming character images on a substrate of this type, character images are first formed using heat-diffusible dyes on a transferring body having an image receiving layer according to the sublimation thermal transfer method, and then the character images on the transferring body are transferred onto the support's surface together with the image receiving layer.

On the foregoing substrate, there may be provided embossment, a signature, IC memory, optical memory, magnetic recording layer or other printings, when necessary. These can be provided in the manufacturing process of the image recording body of the invention (for example, after the formation of the foregoing transparent protective layer), or after the manufacture thereof.

In addition, a cushioning layer or a thermal insulation layer may be provided on a support as disclosed in Japanese Patent O.P.I. Publication Nos. 236794/1985 and 258793/1986, for the purpose of preventing image defects like white spots and improving sensitivity.

(1) Support

As the support of the foregoing substrate, there may be used various materials such as papers including paper, coated paper and synthetic paper, e.i. polypropylene or polystyrene paper, or its composite with paper, plastic films and sheets including white polyvinyl chloride resin sheets, white polyethylene terephthalate sheet, transparent polyethylene terephthalate sheet, polyethylene naphthalate sheet, ABS sheet film, AS sheet, polypropylene sheet and polystyrene sheet; metal foils and sheets; and ceramic film and sheets.

In order to obtain sharp images in subsequent processes, it is preferable that a white pigment such as titanium white, magnesium carbonate, zinc oxide, barium sulfate, silica, clay or calcium carbonate be added in the support.

Further, when the image recording body is used as an ID card like a driving license, the support is usually made from a sheet or film comprised of the foregoing white pigment and a vinylchloride type resin described later.

When the substrate is made up into a laminated product comprised of a support and an image receiving layer, the thickness of the support is usually 100 to 1,000 μm, preferably 100 to 800 μm; the thickness of the image receiving layer is usually 100 to 1,000 μm, preferably 200 to 800 μm.

According to a specific requirement, the support may be provided with embossment, a signature, IC memory, optical memory, magnetic recording layer or other printings.

(2) Image Receiving Layer

The image receiving layer formed on the support may contain, besides a binder, various additives and metal-inon-containing compounds each added according to a specific requirement. The image receiving layer may also be made of a binder alone.

1. Binder

As the binder for the image receiving layer, there can be suitably used conventional binders for sublimation thermal transfer recording, such as vinyl chloride type resins, polyester type resins, polycarbonate type resins, acrylic type resins and other heat resistant resins.

However, when a specific requirement arises against an image to be formed according to the invention (for example, a prescribed heat resistance is required of an ID card to be issued), the type or combination of the binder should be selected to satisfy such a requirement. Taking an image's heat resistance as an example, it is preferred for a heat resistance higher than 60° C. to use a binder having a glass transition temperature higher than 60° C., for fear of blur of heat-diffusible dyes.

The type of the binder may be arbitrarily selected, but use of a vinyl chloride type resin is preferred for its high image preservability.

Polyvinyl chloride resin is excellent in practical use and can be a self-supporting image receiving layer by itself. Besides Polyvinyl chloride resin, the foregoing vinyl chloride type resin includes vinyl chloride copolymers, and examples thereof are copolymers of vinyl chloride and other comonomers in which vinyl chloride accounts for more than 50% of the monomer units.

Typical examples of the comonomer include vinyl esters such as vinyl acetate, vinyl propionate, vinyl ester of tallow acid; acrylic acid, methacrylic acid and their alkyl esters such as acrylic acid, methacrlic acid, methyl acrylate, ethyl methacrylate, butyl acrylate, 2-hydroxyethyl methacrylate, 2-ethylhexyl acrylate; maleic acid and its alkyl esters such as maleic acid, diethyl maleate, dibutyl maleate, dioctyl maleate; and alkyl vinyl ethers such as methyl vinyl ether, 2-ethylhexyl vinyl ether, lauryl vinyl ether, palmityl vinyl ether, stearyl vinyl ether. Other examples of the comonomer include ethylene, propylene, acrylonitrile, methacrylonitrile, styrene, chlorostyrene, itaconic acid and its alkyl esters, crotonic acid and its alkyl esters, halogenated olefines including dichloroethylene and trifluoroethylene, cyclic olefines such as cyclopentene, aconitates, vinyl benzoate and benzoyl vinyl ether.

The vinyl chloride copolymer may be any of a block copolymer, graft copolymer, alternative copolymer and random copolymer. According to a specific requirement, it may be a copolymer with a compound having a releasing function such as silicon compound.

Besides the vinyl chloride type resin, a polyester type resin can be favorably used as a material to form an image receiving layer for sublimation thermal transfer.

Preferable polyester type resins are those described in Japanese Patent O.P.I. Publication Nos. 188695/1983 and 244696/1987. Further, a polycarbonate type resin can also be used; examples thereof can be seen in Japanese Patent O.P.I. Publication No. 169694/1987.

2. Additives

The image receiving layer may contain a releasing agent, anti-oxidant, UV absorbent, light stabilizer, filler, inorganic fine particles, organic resin particles, and pigment. A plasticizer or thermal solvent may be added as a sensitizer.

The releasing agent can improve the peeling property between a thermal transfer ink sheet described later and the image receiving layer.

Examples of such a releasing agent include silicone oils including those called silicone resins solid waxes such as polyethylene wax, amide wax, Teflon powder; and surfactants of fluorinated type and phosphate type. Of them, modified silicone polymers are particularly preferred.

As the modified silicone polymer, use is made of a polyester modified silicone resin or silicone modified polyester resin, acryl modified silicone resin or silicone modified acrylic resin, urethane modified silicone resin or silicone modified urethane resin, cellulose modified silicone resin or silicone modified cellulose resin, alkyd modified silicone resin or silicone modified alkyd resin and epoxy modified silicone resin or silicone modified epoxy resin.

A releasing agent layer may also be formed on one portion of the image receiving layer by dissolving or dispersing a releasing agent in a solvent and coating it on a desired portion, followed by drying.

For fear of adhesion to a protective layer, it is preferred to use a releasing agent such as silicone in an amount as small as possible or not to use at all.

As the anti-oxidant, there may be employed those anti-oxidants which are described in Japanese Patent O.P.I. Publication Nos. 182785/1984, 130735/1985 and 127387/1989, as well as conventional compounds used in photographs or other image recording materials for the improvement of image durability.

Examples of the UV absorbent and light stabilizer include those described in Japanese Patent O.P.I. Publication Nos. 158287/1984, 74686/1988, 145089/1988, 196292/1984, 229594/1987, 122596/1988, 283595/1986 and 204788/1989, as well as conventional compounds used in photographs or other image recording materials for the improvement of image durability.

Examples of the filler include inorganic fine particles and organic resin particles. The inorganic fine particles include silica gel, calcium carbonate, titanium dioxide, acid clay, activated clay and alumina. The organic resin particles include fluororesin particles, guanamine resin particles, acrylic resin particles and silicone resin particles. The addition amount of these inorganic or resin particles is, though varies according to their specific gravity, preferably 0.1 to 70 wt %.

Typical examples of the pigment are titanium white, calcium carbonate, zinc oxide, barium sulfate, silica, talc, clay, kaolin, activated clay and acid clay.

As the plasticizer, there may be used phthalates such as dimethyl phthalate, dibutyl phthalate, dioctyl phthalate, didecyl phthalate; trimellitates such as octyl trimellitate, isononyl trimellitate, isodecyl trimellitate; pyromellitates such as octyl pyromellitate; adipates such as dioctyl adipate, methyl lauryl adipate, di-2-ethylhexyl adipate, ethyl lauryl adipate; and other compounds such as oleates, succinates, maleates, sebacates, citrates, epoxidized soybean oil, epoxidized linseed oil, epoxy stearic acid epoxides, phosphates such as triphenyl phsphate and tricresyl phosphate, phosphites such as triphenyl phosphite, tris-tridecyl phosphite and dibutyl hydrodiene phosphite, and glycol esters such as ethylphthalyl ethylglycolate, butylphthalyl butylglycolate. An excessive amount of the plasticizer deteriorates image preservability; accordingly, the addition amount of the plasticizer is usually in the range of 0.1 to 30 wt % per binder contained in the image receiving layer.

As the thermal solvent, there may be used monomolecular compounds such as alcohols including terpineol, menthol, 1,4-cyclohaxane diol, phenol; amides including acetamide, benzamide; esters including coumarin, benzyl cinnamate; ethers including diphenyl ether, crown ether; ketones including camphor, p-methyl acetophenone; aldehydes including vanillin, dimethoxy benzaldehyde; hydrocarbons including norbornene, stilbene; higher fatty acids including margaric acid; higher alcohols including eicosanol; higher fatty esters including cetyl palmitate; higher fatty amides including stearamide; higher amines including behenylamine; waxes such as carnauba wax, beeswax, paraffin wax, ester wax, montan wax, amide wax; rosin derivatives such as ester gum, rosin maleic acid resin, rosin phenolic acid; and high molecular compounds such as phenolic resin, ketone resin, epoxy resin, diallyl phthalate resin, terpene resin, aliphatic hydrocarbon resin, cyclopentadiene resin, polyolefin resin, polyolefin oxides including polyethylene glycol and polypropylene glycol.

In the invention, the above thermal solvents preferably have a melting point or a softening point of 10° to 150° C.

3. Metal-Ion-Containing Compounds

In forming the image receiving layer, a metal-ion-containing compound may be added therein when necessary.

Metal ions comprised of such metal-ion-containing compounds are divalent and polyvalent metals belonging to the groups I to VIII in the periodic table. Preferable examples thereof include Al, Co, Cr, Cu, Fe, Mg, Mn, Mo, Ni, Sn, Ti, Zn; and Ni, Cu, Co, Cr, Zn are particularly preferred.

As such metal-ion-containing compounds, inorganic or organic salts of these metals and complexes of these metals are preferred. Typical examples are those complexes containing $Ni^{2+}$, $Cu^{2+}$, $Co^{2+}$, $Cr^{2+}$ or $Zn^{2+}$ which are represented by the following formula.

$$[M(Q_1)_k(Q_2)_m(Q_3)_n]^{p+}{}_p(L-)$$

In the formula, M represents a metal ion; $Q_1$, $Q_2$ and $Q_3$ each represent a coordinated compound capable of forming a coordinated bond with a metal ion, and such a coordinated compound can be selected from the coordinated compounds described, for example, in Chelate Chemistry (5), Nankodo Co. Preferred coordinate compounds are those having at least one amino group capable of forming a coordinated bond with a metal; typical examples thereof are ethylenediamine and its derivatives, glycine amide and its derivatives, and picoline amine and its derivatives.

L represents a counter anion to form a complex, examples thereof include inorganic compound anions such as Cr, $SO_4$, $ClO_4$ and organic compound anions such as benzene sulfonates and alkyl sulfonates. And particularly preferred ones are tetraphenyl boron anion and its derivatives, as well as alkylbenzene sulfonate and its derivatives.

k represents an integer of 1, 2 or 3; m represents 1, 2 or 0; n represents 1 or 0; and these depend upon whether the complex represented by the foregoing formula is a four-coordinate complex or a six-coordinate complex, or the number of ligands contained in $Q_1$, $Q_2$ and $Q_3$. p represents 1,2 or 3.

Suitable examples of such metal-ion-containing compounds are those exemplified in U.S. Pat. No. 4,987,049.

When these metal-ion-containing compounds are added in the image receiving layer, the addition amount is 0.5 to 20 g/m$^2$, preferably 1 to 15 g/m$^2$.

(3) Formation of the Image Receiving Layer

The image receiving layer of the invention can be formed by the coating method, which comprises the steps of dissolving or disprsing components of the layer in a solvent to prepare a coating solution for image receiving layer, and coating the solution on the foregoing support, followed by drying.

In another embodiment, the image receiving layer is formed by the lamination method, in which a composition to form the image receiving layer is extruded on a support in a molten state.

The thickness of the image receiving layer formed on a support is generally 2 to 50 μm, preferably 3 to 20 μm.

In case that the image receiving layer is self-supporting and constitutes a support by itself, the thickness of the image receiving layer is 60 to 200 μm, preferably 90 to 150 μm.

In the invention, a cushioning layer or a barrier layer may be provided between the image receiving layer and the support.

When a cushioning layer is provided, generation of noise is reduced, and thereby images corresponding to image information can be transferred with a high fidelity.

Suitable materials for this purpose are urethan resin, acrylic resin, ethylene type resin, butadiene rubber and epoxy resin.

The thickness of such a cushioning layer is usually 1 to 50 μm, preferably 3 to 30 μm.

B. Formation of Gradation Images and Character Images

Gradation images are formed on the image receiving layer by the sublimation thermal transfer method with a sublimation thermal transfer recording ink sheet containing heat-diffusible dyes. Character images are formed on an area of the image receiving layer where no gradation images are formed, by use of a fusible thermal transfer ink sheet or a sublimation thermal transfer ink sheet.

(1) Ink Sheet for Sublimation Thermal Transfer Recording Ink Sheet

The ink sheet for sublimation thermal transfer recording hereinafter referred to as sublimation ink sheet, can be formed in a structure well known in the art; that is, it is usually prepared by providing on a support an ink layer containing heat-diffusible dyes.

1. Ink Layer

The above ink layer containing heat-diffusible dyes is basically composed of heat-diffusible dyes and a binder.

Heat-Diffusible Dye

As the heat-diffusible dye, conventional heat-diffusible cyan dyes, magenta dyes and yellow dyes can be used.

Examples of such cyan dyes include those naphthoquinone dyes, anthraquinone dyes and azo methine dyes which are disclosed in Japanese Patent O.P.I. Publication Nos. 78896/1984, 227948/1984, 24966/1985, 53563/1985, 130735/1985, 131292/1985, 239289/1985, 19396/1986, 22993/1986, 31292/1986, 31467/1986, 35994/1986, 49893/1986, 148269/1986, 191191/1987, 91288/1988, 91287/1988 and 290793/1988

Examples of such magenta dyes include those anthraquinone dyes, azo dyes and azo methine dyes which are disclosed in Japanese Patent O.P.I. Publication Nos. 78896/1984, 30392/1985, 30394/1985, 253595/1985, 262190/1986, 5992/1988, 205288/1988, 159/1989 and 63194/1989.

Examples of such yellow dyes include those methine dyes, azo dyes, quinophthalone dyes and anthraisothiazole dyes which are disclosed in Japanese Patent O.P.I. Publication Nos. 78896/1984, 27594/1985, 31560/1985, 53565/1985, 12394/1986 and 122594/1988.

Among these heat-diffusible dyes, particularly preferred ones are azo methine dyes obtained by coupling a compound having an open or closed chain active methylene group with an oxidation product of a p-phenylenediamine derivative or an oxidation product of a p-aminophenol derivative, and indoaniline dyes obtained by coupling a phenol derivative or a naphthol derivative with an oxidation product of a p-phenylenediamine derivative or an oxidation product of a p-aminophenol derivative.

For an image recording body carrying a monochromatic image, the heat-diffusible dye contained in the ink layer may be any of a yellow dye, magenta dye and cyan dye.

When the image receiving layer contains a metal-ion-containing compound, it is preferred to employ a sublimation dye which can form a chelate together with this metal-ion-containing compound.

As the dye to form a chelate jointly with a metal-ion-containing compound, there may be selected a suitable one from a variety of conventional compounds. For example, there can be used such cyan image forming dyes (hereinafter referred to as cyan dyes), magenta image forming dyes (hereinafter referred to as magenta dyes) and yellow image forming dyes (hereinafter referred to as yellow dyes) as are disclosed in Japanese Patent O.P.I. Publication Nos. 78893/1984, 109349/1984 and Japanese Patent Application Nos. 213303/1990, 214719/1990, 203742/1990.

Among these dyes, ones capable of forming a two-coordinate chelate with the above metal-ion-containing compound are preferably used. Preferable examples of such a dye are those represented by the following formula.

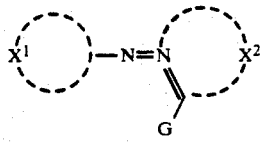

In the formula, $X^1$ represents an aromatic carbon ring in which at least one ring is comprised of 5 to 7 atoms, or a group of atoms necessary to form a heterocycle, and at least one of carbon atoms adjacent to the carbon atom connecting with the azo bond is linked to a substituent nitrogen atom or chelating group. $X^2$ represents an aromatic heterocycle or an aromatic carbon, in each of which at least one ring is comprised of 5 to 7 atoms.

Whichever dyes are used, there may be contained two or more of the above three types of dyes, or other sublimation dyes, according to the color tone of images to be formed.

The above heat-diffusible dye is used in an amount of 0.2 to 10 g, preferably 0.3 to 3 g per $m^2$ of support.

Binder

As the binder for a heat-diffusible dye containing ink layer, there may be used cellulosic resins such as ethyl cellulose, hydroxyethyl cellulose, ethylhydroxyethyl cellulose, hydroxypropyl cellulose, methyl cellulose, cellulose actate, cellulose acetate butyrate; vinyl type resins such as polyvinyl alcohol, polyvinyl formal, polyvinyl butyral, polyvinylpyrrolidone, polyester, polyvinyl acetate, polyacrylamide, polyvinyl acetacetal, polystyrene, styrene copolymer resin, polyacrylate, polyacrylic acid, acrylic acid copolymer; and rubber type resin, ionomer resin, olefin type resin.

Among these resins, polyvinyl butyral, polyvinyl acetacetal and cellulosic resins are advantageously used for their high acid resistance.

These binders may be used, singly or in combination, at a binder to heat-diffusible dye weight ratio of 1:10 to 10:1, preferably 2:8 to 8:2.

Other Optional Components

The heat-diffusible dye containing ink layer may contain various additives within the limits not hurtful to the effect of the invention.

Such additives include releasing compounds such as silicone resin, silicone oil including reaction-curable type, silicone modified resin, fluororesin, surfactant; fillers such as metal fine powder, silica gel, metal oxide, carbon black, resin fine powder; and hardeners which can react with a binder component, for example, irradiation-curable compounds of isocyanate, acrylic or epoxy type.

Other examples of the additive are heat-fusible substances to accelarate the transfer of dye, such as waxes and higher fatty esters, described in Japanese Patent O.P.I. Publication No. 106997/1984.

2. Other Layers

The sublimation ink sheet is not necessarily limited to the double layered structure comprised of a support and an ink layer. And other layers may be formed.

For example, an overcoat layer may be provided on the ink layer in order to prevent the fusion with the image receiving layer in the substrate and blocking of heat-diffusible dyes.

A subbing layer may be provided on the support for the purposes of enhancing adhesion to binders and preventing heat-diffusible dyes from transferring or migrating into the support.

Further, an antisticking layer may also be formed on the backside of the support (on the reverse of the ink layer), in order to prevent the thermal head from fusing or sticking to the support and the sublimation ink sheet from crumpling.

The thickness of the overcoat layer, subbing layer or antisticking layer is usually 0.1 to 1 μm.

3. Support

The support for the sublimation ink sheet is not particularly limited in material as long as a material used has a good dimensional stability and withstands the heat applied by the thermal head in the recording process. For example, there can be used the film and sheets described in Japanese Patent O.P.I. Publication No. 193886/1988, from the 12th line to the 18th line of the lower left column of the 2nd page.

The thickness of the support is preferably 2 to 10 μm, and the support may have a subbing layer, in order to improve adhesion to binders and prevent dyes from transferring or migrating to the support.

Further, an antisticking layer may be provided on the backside e.i. on the reverse of the heat-diffusible dye containing ink layer of the support, in order to prevent the thermal head from fusing or sticking to the support and the sublimation thermal transfer recording ink sheet from crumpling.

The thickness of the antisticking layer is usually 0.1 to 1 μm.

(2) Manufacture of Sublimation Thermal Transfer Recording Ink Sheet

The sublimation thermal transfer recording ink sheet can be manufactured by dispersing or dissolving the foregoing ink layer components to prepare a coating solution to form the ink layer, coating it on the support and then drying.

(3) Ink Sheet for Heat-Fusible Thermal Transfer Recording

The ink sheet for heat-fusible thermal transfer recording hereinafer referred to as heat-fusible ink sheet can be formed by laminating a heat-fusible ink layer on a support. This heat-fusible ink sheet may have other layers within the limits not hurtful to its characteristics. For example, a peelable layer may be provided between the heat-fusible ink layer and the support; an intermediate layer may be formed between this peelable layer and the support; or another layer may be laminated on the heat-fusible ink layer, that is, an ink-protecting layer may be provided as the uppermost layer. The above peelable layer and heat-fusible ink layer may be formed in multi-layered structure when necessary.

1. Support

The support used in the heat-fusible ink sheet is desired to have a good heat resistance and a high dimensional stability.

As a material for such a support, there may be used, for example, film or a sheet described in Japanese Patent O.P.I. Publication No. 193886/1988, from the 12th line to the 18th line in the lower left column of the 2nd page.

The thickness of the support is usually not more than 30 μm, preferably 2 to 30 μm. A thickness larger than 30 μm lowers thermal conductivity and may impair the quality of character images.

In this heat-fusible ink sheet, the backside of the support may have an arbitrary structure; for example, a backing layer may be provided there to improve running stability, antistatic property and heat stability.

2. Heat-Fusible Ink Layer

The heat-fusible ink layer is comprised of a heat-fusible compound, thermoplastic resin and colorant.

Heat-Fusible Compound

The heat-fusible compound may be arbitrarily selected from conventional ones usable in a heat-fusible ink layer of this type heat-fusible ink sheet. Typical examples of such heat-fusible compounds include low molecular weight compounds of thermoplastic resins represented by polystyrene resin, acrylic resin, styrene-acryl resin, polyester resin, polyurethane resin; the compounds exemplified in Japanese Patent O.P.I. Publication No. 193886/1988, from the 8th line of the upper left column to the 12 line of the upper right column on the 4th page; rosin and its derivatives such as rosin, hydrogenated rosin, polymerized rosin, rosin modified glycerine, rosin modified maleic acid resin, rosin modified polyester resin, rosin modified phenolic resin, ester gum; and phenolic resin, terpene resin, ketone resin, cyclopentadiene resin, aromatic hydrocarbon resin.

As such heat-fusible compounds, ones having a molecular weight of less than 10,000, particularly less than 5,000, and a melting point or softening point of 50 to 150° C. are especially preferred.

These heat-fusible compounds may be used singly or in combination of two or more kinds.

Thermoplastic Resin

The thermoplastic resin used as a component of the heat-fusible ink layer may be selected from various conventional resins used in a heat-fusible ink layer of this type heat-fusible ink sheet. Usable ones include, for example, the compounds exemplified in Japanese Patent O.P.I. Publication No. 193886/1988, from the upper right column on the 4th page to the 18th line of the upper left column on the 5th page Colorant As the colorant used in the heat-fusible ink layer, there may be employed without limitation those used in a heat-fusible ink layer of this type heat-fusible ink sheet. Examples of such colorants include the inorganic pigments, organic pigments and organic dyes described in Japanese Patent O.P.I. Publication No. 193886/1988, from the 3rd line to the 15th line of the upper right column on the 5th page.

These colorants may be used singly or in combination of two or more types.

Additional Components

According to a specific requirement, the heat-fusible ink layer may contain other additional components within the limits not hurtful to the effect of the invention.

For example, this heat-fusible ink layer may contain a fluorine-containing surfactant in order to prevent the heat-fusible ink layer from being blocked. Further, addition of organic fine particles, inorganic particles or noncompatible resins is also useful to improve the sharpness of transferred character images, or to sharpen the transferred characters.

Thickness of the Heat-Fusible Ink Layer and Formation Thereof

The thickness of the heat-fusible ink layer is usually 0.6 to 5.0 μm, preferably 1.0 to 4.0 μm.

This heat-fusible layer may be formed by the organic solvent method which comprises dispersing or dissolving of layer forming components in an organic solvent that is followed by coating, or by the extrusion coating method which comprises coating of thermally softened or molten thermoplastic resin. But it is preferable that the layer be formed by coating an emulsion or a solution prepared by dispersing or dissolving layer forming components in water or an organic solvent.

The total content of such layer forming components in a coating solution for heat-fusible ink layer is usually set within the range of 5 to 50 wt %.

The coating can be performed by use of conventional methods, such as wire bar coating, squeeze coating and gravure coating.

Further, the heat-fusible layer, which must be provided at least one layer, may be comprised of two or more layers different in type and content of colorant or in mixing ratio of thermoplastic resin and heat-fusible compound.

3. Peeling Layer

The peeling layer is provided for the purpose of making the layers provided on this peeling layer, at least one of them contains colorants, to be peeled and transferred quickly enough, when heated at the time of image formation by a heating means such as thermal head. Accordingly, this layer is made up into a layer having a predominant attribute of the heat-fusible compound, particularly an excellent meltpeeling property, by use of a heat-fusible compound appropriate for this purpose.

The peeling layer may be comprised of the above heat-fusible compound alone, but it is usually comprised of a mixture of heat-fusible compound and thermoplastic resin.

The heat-fusible compound, the primary component of the peeling layer, may be properly selected from conventional ones, typical examples of them include the compounds described in Japanese Patent O.P.I. Publication No. 193886/1988, from the 8th line of the upper left column to the 12th line of the upper right column on the 4th page.

Typical examples of the thermoplastic resin include ethylene type copolymers such as ethylene-vinyl acetate copolymer, polyamide resin, polyester resin, polyurethane resin, polyolefin resin, acrylic resin and cellulosic resin. Other examples are resins such as vinyl chloride type resin, rosin type resin, petroleum resin and ionomer resins; elastomers such as natural rubber, isoprene rubber and chloroprene rubber; and rosin derivatives such as ester gum, rosin maletic acid resin, rosin phenol resin and hydrogenated rosin. Aromatic type resins such as phenolic resin, terpene resin and cyclopentadiene resin may be used in a specific case.

Among these thermoplastics, suitable thermoplastic resins used in the invention as a component of the peelable layer are those having a melting point or softening point of usually 50° to 150° C., particularly 60° to 120° C., or those which can have such a melting point or softening point when mixed with each other.

The peeling layer may contain a colorant, when necessary, at an amount of usually not more than 30 wt %, preferably not more than 20 wt % of the total peelable layer components.

The peeling layer is formed to a thickness of usually 0.2 to 4 μm, preferably 0.5 to 2.5 μm.

(4) Preparation of the Heat-Fusible Ink Sheet

The heat-fusible ink sheet can be formed by coating and drying, on a support for the ink sheet, a heat-fusible ink layer coating solution which dissolves or disperses in it heat-fusible ink layer forming components.

(5) Formation of Gradation Images

In forming gradation images, a heat-diffusible dye containing ink layer of a sublimation ink sheet is contacted with an image receiving layer of a substrate, and heat energy is applied thereto imagewise. Heat-diffusible dyes in the heat-diffusible dye containing ink layer sublimates or evaporates by an amount corresponding to the amount of energy applied at the time of image formation and then transfers onto the image receiving layer to form gradation images thereon.

As the heat source, a thermal head is generally used. In addition, other conventional means such as laser beams, an infrared flash and hot pen can also be employed.

When a thermal head is used as the heat source, the supply of energy can be varied continuously or stepwise by modulating the voltage or pulse duration applied to the thermal head.

When a laser beam is used, the amount of heat energy supplied can be varied by changing the luminous energy or irradiaton area of the laser beam.

In this case, it is preferred to have a laser beam absorbing material (in case of semiconductor laser, carbon black or near infrared absorbing material) present in the ink layer or adjacent thereto. Further, it is also preferred to bring a sublimation ink sheet into close contact with an image receiving layer on a substrate.

Use of a dot generator equipped with a built-in acousto-optical device allows to apply a heat energy corresponding to the magnitude of half-tone.

When an infrared flash lamp is used as the heat source, it is preferred to perform heating through a colored layer, such as black, as is the case with a laser beam. Further, it may also be performed through a black pattern continuously expressing the image's light and shade or a black half-tone pattern of the image, or through a combination of an overall colored (like black) layer and a negative pattern corresponding to a negative of the foregoing pattern.

Heat energy may be applied to any of the sublimation thermal transfer recording ink sheet side, the thermal transfer recording image receiving layer side, and the both sides. But, when energy saving is given priority, it is preferred to apply heat energy to the sublimation thermal transfer recording ink sheet side.

According to the above thermal transfer recording, monochromatic images are formed on the image receiving layer of a thermal transfer recording image receiving sheet. And color-photograph-like multicolor images can be obtained by use of the following method.

In one method of forming such multicolor images, thermal transfer is repeated for yellow, magenta, cyan and black by changing, one by one, thermal transfer recording thermosensitive sheets of respective colors.

In another method, use is made of a sublimation ink sheet having zones formed beforehand with respective colors, instead of the above sublimation thermal transfer recording ink sheets for respective colors.

In this case, monochromatic images of yellow are thermally transferred first by use of the yellow zone, then monochromatic images of magenta are thermally transferred by use of the magenta zone, followed by repetition of thermal transfer of cyan, and black if necessary.

After images are formed as above, there may be performed a heat treatment to improve image preservability. For example, heating with a thermal head may be carried out over the whole image forming surface, by use of a portion of a sublimation thermal transfer recording ink sheet where no heat-diffusible is provided. When a near infrared absorbing agent is contained, an image forming surface may be exposed by use of an infrared flash lamp.

In any case, regardless of method for heating, the purpose of heating is to disperse dyes further into the image receiving layer; accordingly, it is preferred to perform the heating onto the support side of an image receiving layer.

(6) Formation of Character Images

The method of heat-fusible transferring using the above heat-fusible ink sheet is not different from that of a conventional thermosensitive recording methods. An explanation is made on this method taking the case of using a thermal head as the heat source as an example.

First, a heat-fusible ink layer of a heat-fusible ink sheet is contacted with an image receiving layer of a substrate, and thermal pulses are further given to the heat-fusible ink layer with a thermal head when necessary, so that the heat-fusible ink layer is locally heated correspondingly to characters or patterns to be transferred.

The heated portion of the heat-fusible ink layer rises in temperature and rapidly softens to be transferred to the image receiving layer.

The formation of those characters, diagrams, signs and rule marks which require no gradation may be carried out either before or after the formation of the foregoing gradation images.

Further, these character images may be formed by use of the foregoing sublimation thermal transfer recording ink sheet.

C. Transparent Protective Layer

This transparent protective layer is laminated on the image receiving layer, in order to improve fixation of image forming dyes or protect image information on the image receiving layer during the use over a long period. The area to be covered with the transparent protective layer spreads all over the image receiving layer. This transparent protective layer can be formed by hot stamping as described later.

This transparent protective layer is formed on the image receiving layer for purposes of improving fixation of dyes which form an image on the surface of the image receiving layer and protecting image information during a long period of preservation. The area covered with the transparent layer extends over the whole image receiving layer. Usually, this transparent protective layer is formed beforehand on a protective layer forming thermal transfer sheet, and transferred by means of a hot stamping apparatus onto an image receiving layer carrying an image. The protective layer forming thermal transfer sheet is composed of a transparent protective layer, an adhesive layer to adhere the transparent protective layer to the image receiving layer, and a support to bear them. Further, a peeling layer may be provided between the support and the transparent protective layer. It is preferable that a UV absorbent for protecting images be contained in the transparent protective layer or the adhesive layer, or in the peelable layer when occasion demands. Suitable UV absorbents include those of benzophenone type, benzothiazole type and salicylic acid type; fine particles of titanium dioxide or zinc oxide can also be used. The addition amount of such UV absorbents is preferably 0.2 to 2 $g/m^2$ in total.

The transparent protective layer can be formed, for example, of a vinyl acetal resin such as polyvinyl butyral or polyvinyl acetoacetal, polyacrylic resin, polyester resin, polyvinyl type resin or cellulosic resin. In particular, the layer can be formed, for example, of a thermofusible compound selected from those exemplified in Japanese Pat. O.P.I. Pub. No. 183881/1988, from the 9th line of the lower left column of page 9 to the 15th line of the upper left column of page 10, or a thermoplastic resin selected from those exemplified in the same patent publication, from the 16th line of the upper left column of page 10 to the 9th line of the lower left column of page 11.

The above transparent protective layer or the adhesive layer may be a curable type. That is, the transparent protective layer or the adhesive layer may be impregnated with a UV-curable monomer or oligomer so as to be cured by irradiation of UV light before or after the transfer. When the transparent protective layer or the adhesive layer is cured, adhesion of the protective layer to the image layer as well as anti-scratching property and solvent resistance of the protective layer are improved, thereby images can be protected much firmer. Typical examples of such UV-curable resins or monomers include epoxy compounds and acrylic compounds.

The adhesive layer can be formed by use of, for example, an ethylene/vinyl acetate copolymer, vinyl chloride copolymer, polyester or polyurethane. The thickness of the transparent protective layer and that of the adhesive layer, though vary case by case, are preferably 0.1 to 3 μm, respectively.

It is a matter of course that the transparent protective layer used in the invention is composed of transparent resins as a whole, and this transparent protective layer may be printed with marks, commonly contained characters and signs. The thickness of such a transparent protective layer is usually 0.5 to 20.0 μm, preferably 1.0 to 10.0 μm.

D. Lamination of the Transparent Protective Layer by Hot Stamping

In the invention, the foregoing transparent protective layer is formed by hot stamping on the whole surface of an image receiving layer carrying the foregoing images.

In this hot stamping, a protective layer forming thermal transfer sheet is used.

This protective layer forming thermal transfer sheet can be prepared in a conventional structure, in which a peeling layer and transparent protective layer, as well as an adhesive layer when necessary, are laminated on a support in this order.

For the simplification of apparatus and process, it is useful to employ a sheet on which a protective layer forming thermal transfer sheet unit and a character information forming thermal transfer unit are alternatively provided.

Figure 2:
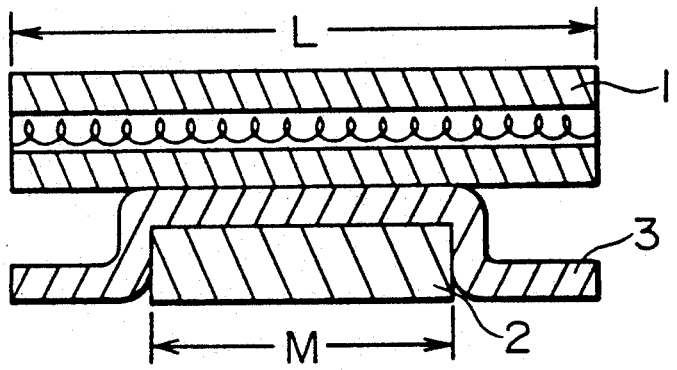
FIG. 2 is a sectional view along the A-A line in FIG. 1.

In the invention, the hot stamping is performed by use of heating roll 1 having contact length L longer than width M of the foregoing image receiving layer as shown in FIGS. 1 and 2. In this hot stamping procedure, protective layer forming thermal transfer sheet 3 is superposed over thermal transfer recording image receiving layer 2 so as to bring the image receiving layer of the former into contact with the protective layer of the latter, then heat and pressure are applied onto protective layer forming thermal transfer sheet 3 by use of heating roll 1.

The protective layer is thus transferred to the whole surface of the image receiving layer. After this, the support of the protective layer forming thermal transfer sheet is peeled from the protective layer.

As described above, the present invention allows the whole surface of an image receiving layer including image-forming portions to be covered with a transparent protective layer. As a result, the fixation of dyes is improved; further, this surface covering provides a fine appearance, because it causes no irregularities on the protective layer including both nonimage-forming portions and image-forming portions unlike conventional methods, and there occurs little thermal deformation or curling, because heat is uniformly applied in a short time to the whole image receiving layer in the hot stamping.

The heating roll used in the hot stamping according to the invention must have a peripheral length longer than the length of the image receiving layer or the length of an ID card); that is, when lr is taken as the diameter of a heating roll, and lc as the length of an ID card in transferring direction of hot stamping, the following relation must be satisfied.

$lc < \pi lr$ ($\pi$ is the circular constant)

The reason for the above lies in the facts that the transparent protective layer can be transferred to the image receiving layer before the heating roll makes one revolution, and that no curling occurs because hot stamping is finished in a short time. On the contrary, the shorter the diameter of a heating roll becomes, the more the number of revolution is; and thereby hot stamping takes much time, eventually leading to curling. Moreover, lowering in adhesive strength may occur due to the temperature drop at a contact area of the heating roll.

The structure of the heating roll may be conventional ones, preferred ones are those which are made of the rubber having a rubber hardness of 50 to 10 and equipped with a heating means, for example, nichrome wires for electric heating, in their hollow portions. As the rubber, silicone rubbers are particularly preferred.

Use of a heating roll whose rubber hardness is less than 50 lowers the adhesion between the protective layer and the image receiving layer, and use of a heating roll whose rubber hardness is more than 100 is liable to cause uneven adhesion between the protective layer and the image receiving layer.

Figure 3:
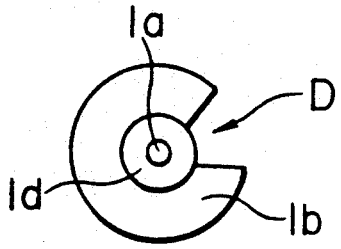
FIG. 3 is a side view showing one example of the heating roll favorably used in the invention.

The heating roll used in the invention may have notch D in the portion which does not contact with card's transfer portion, as shown in FIG. 3, in order to avoid excessive and useless transfer. This heating roll is equipped with heater 1*d* around rotation axis 1*a* and covered its periphery with silicone rubber 1*b*; notch D is provided so as to expose a portion of heater 1 covered by silicone rubber 1*b*.

Figure 4:
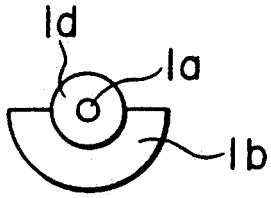
FIG. 4 is a side view showing another example of the heating roll favorably used in the invention.
Figure 5:
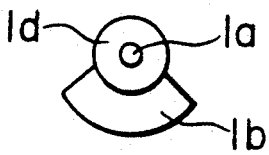
FIG. 5 is a side view showing a third example of the heating roll favorably used in the invention.
Figure 6:
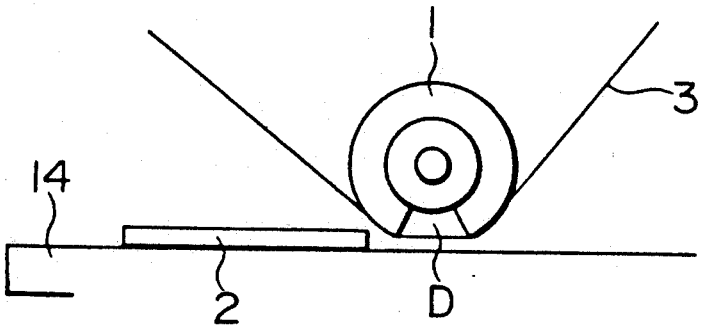
FIG. 6 is an explanation drawing showing the positions of the heating roll and a card in the standby mode of hot stamping.
Figure 7:
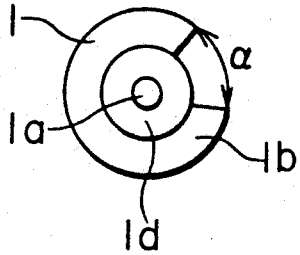
FIG. 7 is a side view illustrating the heating roll for hot stamping used in Example 2 of the invention.
Figure 14:
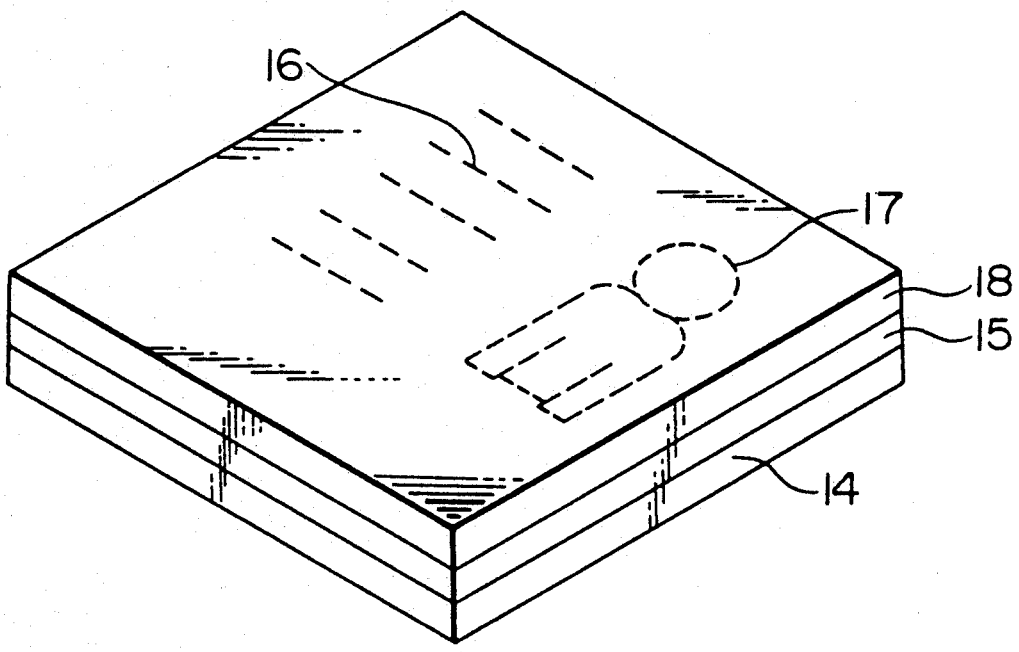
FIG. 14 is an explanation drawing showing one structure of the image recording body obtained by use of the image recording apparatus of the invention.

The shape of the heating roll used in the invention is not necessarily cylindrical as long as its peripheral length is longer than the card length, and may be semicylindrical as shown in FIG. 4 or sectoral as shown in FIG. 5. In one preferable embodiment of the invention, the peripheral length of heating roll is as close as possible to the card length, and in the standby mode during which no card passes through the heating roll section, the tip of notch D is kept halting at a position close to, but not in contact with, conveyer 14 as shown in FIG. 14, then heating roll 1 is rotated in synchronism with incoming of card 2*a*, thereby the periphery of heating roll 1 is prevented from coming in contact with conveyer 14 via hot stamping sheet 3. Accordingly, transfer of the transparent protective layer to the conveyer as well as absorption of heating roll's heat by the conveyer are prevented.

Figure 8:
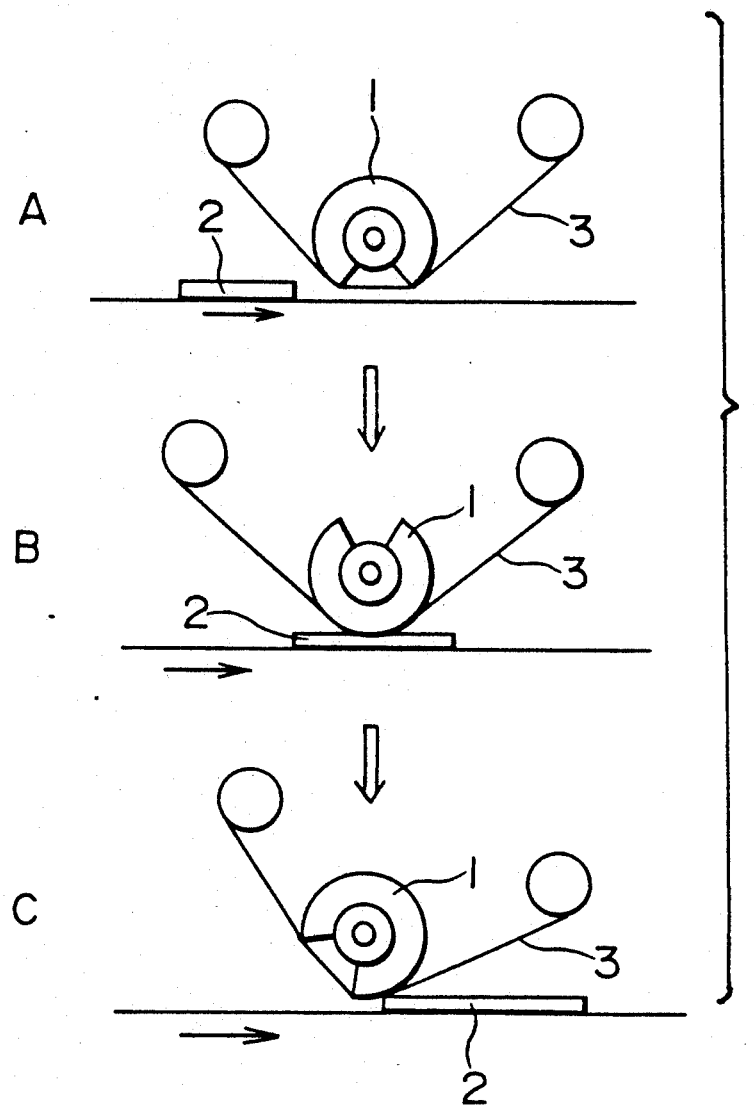
FIG. 8 is an explanation drawing showing one example of the hot stamping process employed in the invention.
Figure 9:
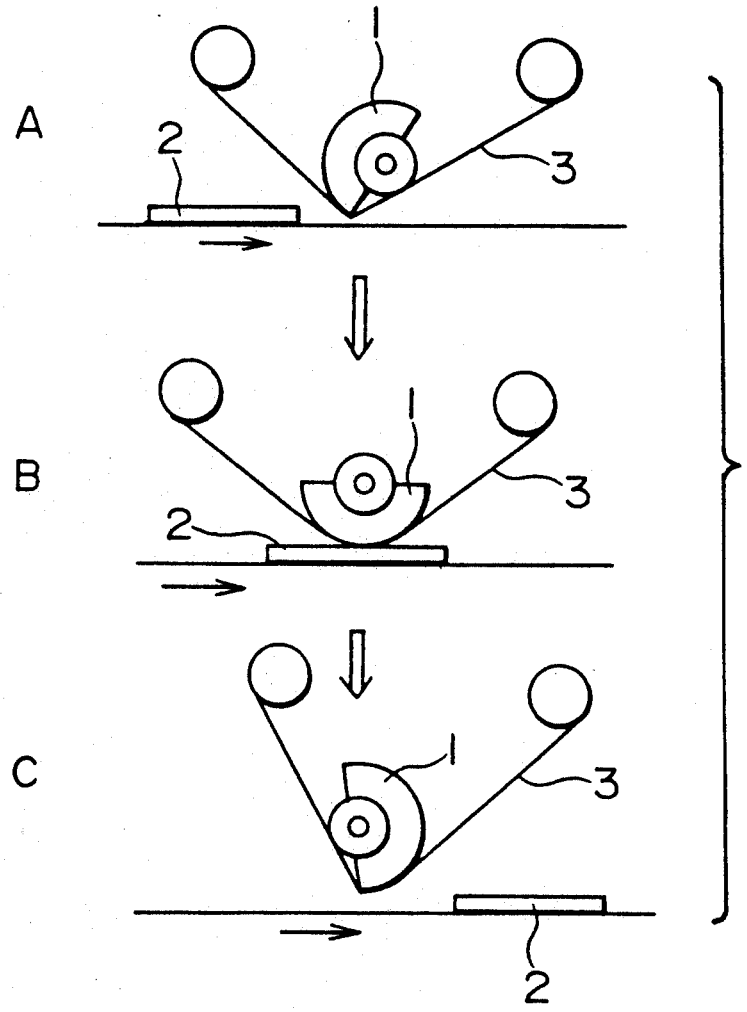
FIG. 9 is an explanation drawing showing another example of the hot stamping process employed in the invention.
Figure 10:
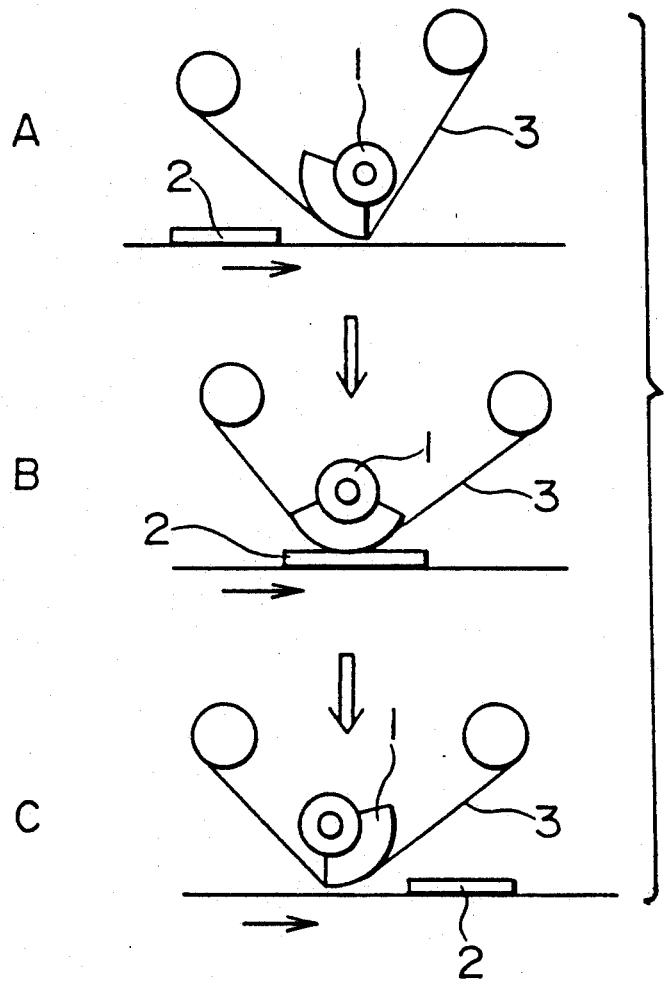
FIG. 10 is an explanation drawing showing a third example of the hot stamping process employed in the invention.

Examples of the hot stamping process respectively using a notched heat roll, semicylindrical heat roll and sectoral heating roll are shown in FIGS. 8 to 10. In each figure, A, B and C show the states of standby time, transferring time and completion of hot stamping, respectively.

II. Image Recording Apparatus

The image recording apparatus used in the invention is equipped with a first heating means to form gradation images on the image receiving layer by sublimation thermal transfer, a second heating means to form character images on the image receiving layer by heat-fusible thermal transfer or sublimation thermal transfer, and a hot stamping device having the above mentioned heat roll.

Figure 13A:
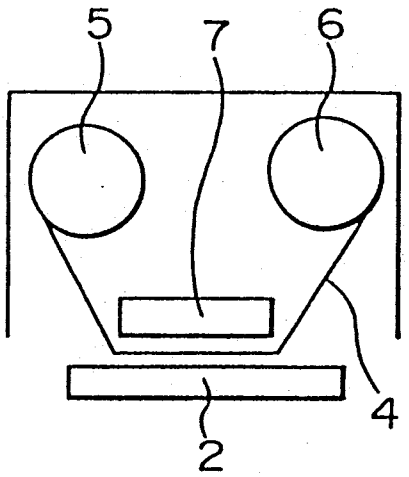
FIGS. 13A–13C are explanatory drawings showing one structure of the image recording apparatus of the invention.
Figure 13B:
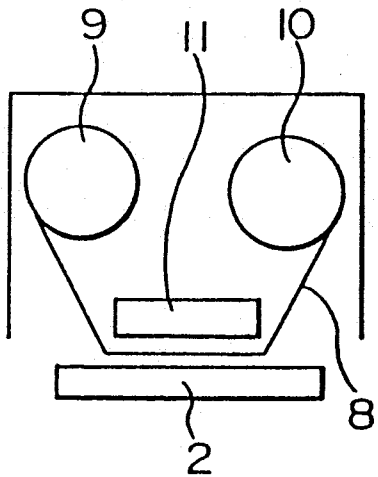
Figure 13C:
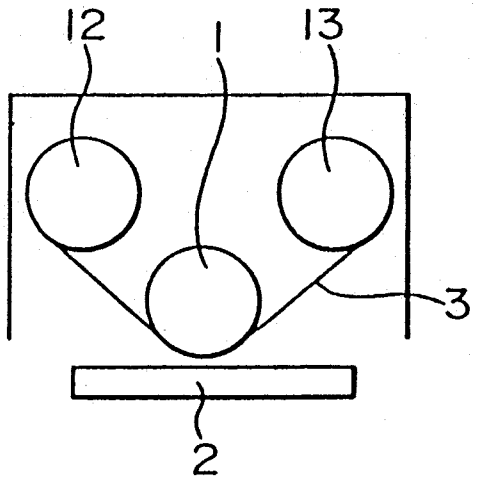

One preferred embodiment is the image recording apparatus shown in FIGS. 13A–13C. This image recording apparatus is equipped with a first section (FIG. 13A) comprising a feed roll 5 for thermal transfer recording ink sheet 4, take-up roll 6, and thermal head 7 positioned between these rolls and the backside of thermal transfer recording ink sheet 4. The apparatus further includes a second section (FIG. 13B) comprising a feed roll 9 for heat-fusible thermal transfer recording ink sheet 8, take-up roll 10, and thermal head 11 positioned between these rolls and the backside of heat-fusible thermal transfer recording ink sheet 8. The apparatus still further includes a third section (FIG. 13C) comprising a feed roll 12 for protective layer forming thermal transfer sheet 3, take-up roll 13, and heating roll 1 for hot stamping positioned between these rolls and backside of protective layer forming thermal transfer sheet 3.

Thermal transfer recording image receiving sheet 2 fed by an unillustrated conveying means is brought into contact with thermal transfer recording ink sheet 4 fed by feed roll 5 so as to have the image receiving layer and the ink layer face each other, and then thermal head 7 performs imagewise heating on the backside of thermal transfer recording ink sheet 4 to form gradation images on the image receiving layer. After image formation, thermal transfer recording ink sheet 4 is wound up by the take-up roll.

Thermal transfer recording image receiving layer 2 carrying gradation images is then brought into contact with heat-fusible thermal transfer recording ink sheet 8 fed by feed roll 9 so as to have the image receiving layer and the ink layer face each other, and then thermal head 11 performs imagewise heating on the backside of heat-fusible thermal transfer recording ink sheet 8 to form character images on the image receiving layer.

Thermal transfer recording image receiving layer 2 carrying gradation images and character images is finally subjected to hot stamping.

Figure 11:
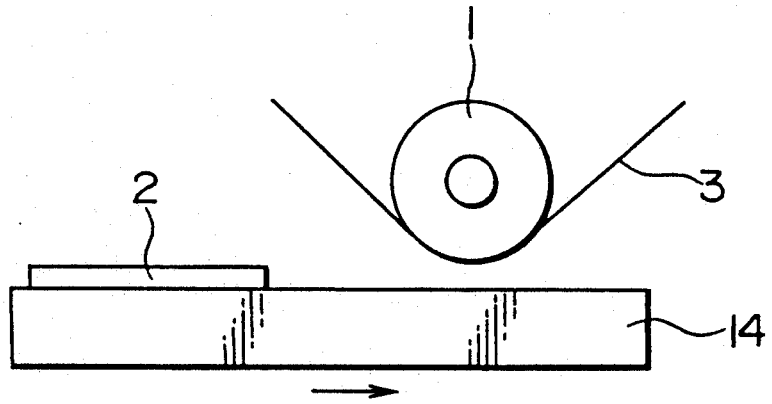
FIG. 11 is an explanation drawing showing one method for conveying cards in the hot stamping process employed in the invention.
Figure 12:
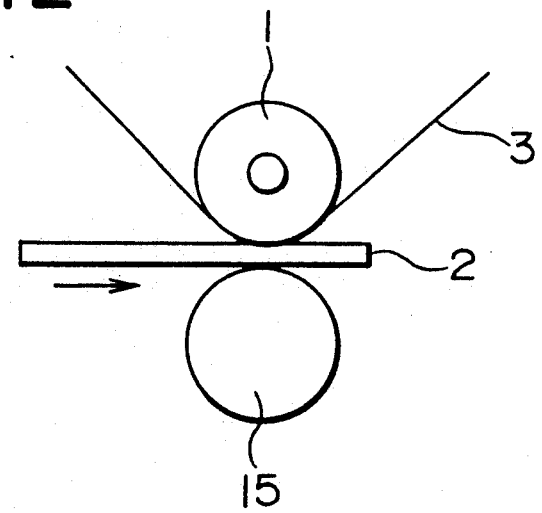
FIG. 12 is an explanation drawing showing another method for conveying cards in the hot stamping process employed in the invention.

That is, thermal transfer recording image receiving layer 2 carrying both types of images is positioned on conveyer 14 as shown in FIG. 11 and brought into contact with protective layer forming thermal transfer sheet 3 so as to have the image receiving layer and the protective layer face each other, then heat and pressure is applied with heating roll 1 onto the backside of protective layer forming thermal transfer recording sheet 3 to form the transparent protective layer on the whole surface of the image receiving layer. In FIG. 11, the transparent protective layer is transferred while thermal transfer recording image receiving layer 2 is fastened to conveyer 14. In another embodiment, conveying roll 15 is provided oppositely to heating roll 1 as shown in FIG. 12, so that thermal transfer recording image receiving layer 2 is sandwiched.

The structure and function of heating roll 1 are the same as described in the preceding paragraphs; therefore, further explanation on them is omitted.

By carrying out the above procedure, an image recording body bearing a transparent protective layer is obtained. When a card-sized image receiving layer is used, the resultant image recording body is an ID card, and the image recording apparatus used constitutes an ID card issuing apparatus.

FIG. 14 shows an example of such an ID card, in which image receiving layer 15 having character image 16 and gradation image 17, and transparent protective layer 18, are laminated on card-sized support 14 in this order.

In the apparatus illustrated in FIGS. 13A–13C heat-fusible thermal transfer recording ink sheet 8 and attachments positioned at the middle may be positioned in front of thermal transfer recording ink sheet 4 and attachments.

In other image recording apparatus according to the invention, laser beams, an infrared flash lamp or a hot pen can be used as the heat source instead of a thermal head.

For the image recording apparatus of the invention, it is preferred to have a dust removing means in order to prevent deterioration in quality of an image recording body with protective layer. To be concrete, it is preferable that dust present on a thermal transfer recording image receiving sheet, thermal transfer recording ink sheet, or protective layer forming thermal transfer sheet be removed by use of an adhesive roll, and that dust floating in the apparatus or found on the above sheets be removed from an air outlet.

EXAMPLES

The examples of the invention are described in detail. "Parts" in the following examples is "parts by weight".

EXAMPLE 1

(1) Preparation of Card-Sized Thermal Transfer Recording Image Receiving Sheet A support was first prepared by extrusion coating of low density polyethylene containing 12% of white pigment ($TiO_2$) to a thickness of 50 μm on both sides of a 500-μm thick and 200-mm wide polyethylene terephthalate sheet (U-100 made by Diafoil Co.). After subjecting the support to corona discharge treatment on both sides, a writing layer coating solution having the following composition was coated and dried to a thickness of 20 μm on the backside of the support.

| Writing layer coating solution | |
|---|---|
| Colloidal silica | 2.5 parts |
| Gelatin | 7.0 parts |
| Hardener | 0.5 part |
| Water | 90.0 parts |

Subsequently, the whole polyethylene surface of the support (opposite side of the writing layer) was coated with the image receiving layer coating solution of the following composition by the wire bar coating method. After drying, a 10-μm thick image receiving layer was obtained.

The image receiving body prepared as above was cut into card-sized image receiving sheets having dimensions of 54.0 mm×85.5 mm.

| Image receiving layer coating solution | |
|---|---|
| Vinyl chloride resin (TK-600 made by Shin-Etsu Chemical) | 9.5 parts |
| Solvent methyl ethyl ketone/cyclohexanone = 8/2 | 90.0 parts |
| Silicone resin (releasing agent) (X-24-8300 made by Shin-Etsu Chemical) | 0.5 part |

(2) Preparation of Sublimation Thermal Transfer Recording Ink Sheet

On the corona discharge treated surface of a 6.0-μm thick polyethylene terephthalate sheet were coated three ink layer coating solutions of the following compositions by the wire bar coating method to a dry thickness of 1 μm, in the longitudinal direction of the polyethylene terephthalate sheet, so as to be coated separately with yellow (Y), magenta (M) and cyan (C). After drying, a backside treatment was carried out by dropping a couple of droplets of silicone oil (X-41-403A made by Shin-Etsu Chemical) on the uncorona treated backside and allowing the silicone oil to spread all over the sheet. Thus, a thermal transfer recording ink sheet comprised of three colors of Y, M and C was obtained.

| | |
|---|---|
| Yellow ink layer coating solution | |
| Yellow disperse dye (MS Yellow made by Mitsui Toatsu Chemical) | 3.0 parts |
| Polyvinyl butyral (BX-1 made by Sekisui Chemical, polymerization degree: 1700, Tg: 85.5° C., acetalized degree: 64 mole %, acetyl group content: less than 3 mole %) | 5.0 parts |
| Polyester modified silicone (X-24-8310 made by Shin-Etsu Chemical) | 0.4 part |
| Toluene | 40.0 parts |
| Methyl ethyl ketone | 40.0 parts |
| Dioxane | 10.0 parts |
| Magenta ink layer coating solution | |
| Magenta disperse dye (MS Magenta made by Mitsui Toatsu Chemical) | 5.0 parts |
| Polyvinyl butyral (BX-1 made by Sekisui Chemical, polymerization degree: 1700, Tg: 85.5° C., degree: 64 mole %, acetyl group content: less than 3 mole %) | 5.0 parts |
| Polyester modified silicone (X-24-8310 made by Shin-Etsu Chemical) | 0.4 part |
| Toluene | 40.0 parts |
| Methyl ethyl ketone | 40.0 parts |
| Dioxane | 10.0 parts |
| Cyan ink layer coating solution | |
| Cyan disperse dye (Kayaset Blue made by Nippon Kayaku) | 4.0 parts |
| Polyvinyl butyral (BX-1 made by Sekisui Chemical, polymerization degree: 1700, Tg: 85.5° C., degree: 64 mole %, acetyl group content: less than 3 mole %) | 5.0 parts |
| Polyester modified silicone (X-24-8310 made by Shin-Etsu Chemical) | 0.4 part |
| Toluene | 40.0 parts |
| Methyl ethyl ketone | 40.0 parts |
| Dioxane | 10.0 parts |

(3) Preparation of Transfer Sheet Having a Heat-Fusible Ink Layer

On the surface of a 4.5-μm thick polyethylene terephthalate sheet was coated coating solutions of the following compositions to form a heat-fusible ink layer comprised of a peeling layer and a colorant layer by the wire bar method, followed by drying. Thus, a heat-fusible ink layer having a thickness of 1.6 μm in total was formed.

| Heat-fusible ink layer coating solutions | |
|---|---|
| Coating solution for peeling layer (0.4 μm) | |
| Ethylene-vinyl acetate copolymer (EV-210 made by Mitsui DuPont Chemical) | 0.3 part |
| Carnauba wax | 9.7 parts |
| Solvent (methyl ethyl ketone/methyl isobutyl ketone = 1:1) | 90.0 parts |
| Coating solution for colorant layer (1.2 μm) | |
| Ethylene-vinyl acetate copolymer (EV-40Y made by Mitsui DuPont Chemical) | 1.0 part |
| Carbon black | 6.0 parts |
| Phenolic resin (TAMANOL 525 made by Arakawa Chemical) | 12.0 parts |
| Methyl ethyl ketone | 80.0 parts |

(4) Preparation of Protective Layer Forming Thermal Transfer Sheet

On a 12-μm thick polyethylene terephthalate sheet was coated and dried a peeling-surface protective layer coating solution having the following composition by the wire bar coating method, so that a 1.0-μm thick peeling-surface protective layer was prepared.

| Peeling-surface protective layer coating solution | |
|---|---|
| Phenoxy resin (Phenotohto P-50 made by Tohto Kasei) | 10.0 parts |
| 1,4-dioxane | 90.0 parts |

Subsequently, a 2.0-μm thick adhesive layer was formed on this peeling-surface protective layer by coating and drying an adhesive layer coating solution having the following composition.

| Adhesive layer coating solution | |
|---|---|
| Acrylic resin (BR-82 made by Mitsubishi Rayon) | 10.0 parts |
| Benzotriazole type UV absorbent Tinuvin 320 made by Ciba Geigy) | 2.0 parts |
| Methyl ethyl ketone | 90.0 parts |

(5) Manufacture of Image Recording Body

A sublimation thermal transfer recording ink sheet was first superposed on a thermal transfer recording image receiving sheet, and heat was imagewise applied therto with the thermal head under conditions of output: 0.23 W/dot, pulse duration: 0.3 to 4.5 sec, dot density: 16 dots/mm to form a portrait with gradation on the image receiving layer.

Subsequently, a heat-fusible ink layer of the foregoing transfer sheet was superposed on the surface of the image receiving layer which carries the portrait, then heat was applied thereto with the thermal head under conditions of output: 0.5 W/dot, pulse duration: 1.0 msec, dot density: 16 dots/mm to transfer character information to the image receiving layer.

Next, a transparent protective layer was formed all over the surface of the image receiving layer with the hot stamping means.

That is, a protective layer forming thermal transfer sheet was superposed on the image receiving layer, then heat and pressure were applied thereto by use of a silicone rubber heating roll (rubber hardness: 80) having a diameter of 30 mm and a contact length of 70 mm as shown in FIG. 1, under conditions of temperature: 210° C., pressure: 20 kg/cm$^2$, transfer speed 2.5 cm/sec, so that the transparent protective layer was transferred to the whole surface of the image receiving layer. Then, the support of the protective layer forming thermal transfer sheet was peeled off.

The properties of the resultant image receiving body, namely dye fixation, adhesion and curling of the protective layer and appearance, as well as transfer of the protective layer to the conveyer, were evaluated by the following criteria:

Adhesion

Latticed incisions were made on the transferred transparent protective layer with a knife so as to make 3-mm square sections, and a strip of adhesive tape (Super Tape T-H-24 made by Kokuyo Co.) was stuck thereto. Then, the tape was quickly peeled off in the direction of 180 to see the adhesive strength of the protective layer.

Ones which lost 20% or more of the square sections were rated as C, and ones which lost no square section were rated as A.

Curling

Each of the card-shaped samples was placed on a horizontal desk with its image recording side up. While pressing one corner of the sample with a finger, the raise of the diagonal corner from the desk was measured. A raise of less than 1 mm was rated as A, that of 1 to 5 mm as B, and that of more than 5 mm as C.

Appearance

The appearance immediately after the transfer of the protective layer was observed. Ones having a twist or a burr of the transferred layer were rated as C.

Transfer of the Protective Layer to the Conveyer

Ones which allowed a portion of the protective layer to protrude beyond the card in the transfer and remain on the conveyer were rated as B, and ones without defect were rated as A.

COMPARATIVE EXAMPLE 1

A transparent protective layer was transferred in the same manner as in Example 1, except that a 20-mm diameter silicone rubber roll was used as the heating roll. The properties of the image recording body so obtained were evaluated. The results are shown in Table 1.

COMPARATIVE EXAMPLE 2

A transparent protective layer was transferred onto the card in the same manner as in Example 1, except that the contact length of the heating roll was changed from 70 mm to 40 mm.

Figure 15:
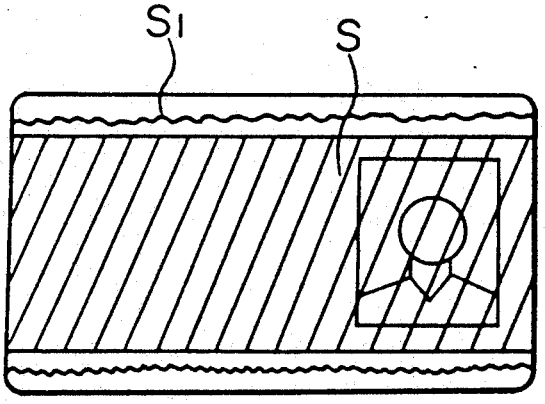
FIG. 15 is an explanation drawing showing the structure of the image recording body obtained in Comparative example 2.

The evaluation of the resultant image recording body gave the results shown in Table 1. This image recording body had the surface shown in FIG. 15 and dimensions of 54-mm width and 85.5-mm length, in which the portion covered with oblique lines, including gradation images (40 mm wide), is the transferred portion S and the portion protruding beyond the transferred portion is $S_1$.

EXAMPLE 2

A transparent protective layer was transferred in the same manner as in Example 1, except that a heating roll (peripheral length: 85.6 mm) whose silicone rubber was notched at an angle of α (33°) with respect to the axis center of the roll was employed, and that the cycle of card conveyance was modified so as to have the incoming of a card's tip into the roll section trigger rotation of the roll, which was on standby to allow the tip of the notch to agree with the tip of an incoming card. The evaluation results of the properties are shown in Table 1.

TABLE 1

| | Adhesion | Curling | Appearance | Transfer to conveyer |
|---|---|---|---|---|
| Example 1 | A | A | A | B |
| Comparative example 1 | C | C | C | B |
| Comparative | A | C | C | B |

TABLE 1-continued

| | Adhesion | Curling | Appearance | Transfer to conveyer |
|---|---|---|---|---|
| example 2 | | | | |
| Example 2 | A | A | A | A |

As seen in Table 1, Comparative example 1 with a heating roll having a peripheral length shorter than the card's length caused curling, because the transfer to the latter half of the card was made at a lower surface temperature of the roll and thereby the card's heat history became uneven. In addition, the adhesion was poor at the portion where the transfer was made at a lower temperature. On the contrary, Example 1 caused no curling and exhibited an excellent adhesion, because the heating roll's peripheral length was longer than the card's length so that the transfer was made at a constant temperature.

In Comparative example 2, the adhesion was good, but burrs were formed on the periphery when the support of the protective layer forming thermal transfer sheet was peeled off, which impaired the appearance markedly and took an extra time to be removed, because the heating roll's contact length was shorter than the card's length. In addition, since both a transferred portion and a non-transferred portion of transparent protective layer were present on the card's surface, difference in level was observed on the boundary, this deteriorated the quality of the card, too. Moreover, the card was a little twisted since heat was applied only to the card's central portion.

In Example 2, the heating roll did not contact with the conveyer via the protective layer forming thermal transfer sheet so that the transfer layer was not transferred to the conveyer needlessly, because a notch was provided in the roll's non-transferring portion. Further, this helped prevent the heat from escaping from the roll to the conveyer. In hot stamping of conventional techniques, a heating roll must be kept raised with a hydraulic cylinder or the like in the standby mode in which no card comes in; accordingly, the apparatus inevitably becomes large and complicated. In any embodiment of the invention, however, such a mechanism is not required and thereby the apparatus can be greatly simplified.

What is claimed is:

1. An image recording method comprising steps of forming a gradation information containing-image on an image receiving layer of an image recording body by means of a thermal sublimation image transfer method, forming a character information containing-image on said image recording layer by means of a thermal sublimation image transfer method or a thermal fusion image transfer method, and then transferring a transparent protective layer from a protective layer forming thermal transfer sheet on the surface of said image receiving layer by a hot stamping means having a heating roll so as to cover the whole area of said surface of said image receiving layer, wherein sad heating roll has a contacting length longer than the width of said image receiving layer and a peripheral length longer than the length of said image receiving layer.

2. The method of claim 1, wherein said transparent protective layer has a thickness of from 1.0 μm to 10 μm.

3. The method of claim 1, wherein said image receiving layer has a substrate having a thickness of from 200 μm to 800 μm.

4. The method of claim 1, wherein said transparent protective layer has characters printed in the area other than the area covering said gradation image.

5. The method of claim 1, wherein said transparent protective layer contains a UV absorbent.

6. The method of claim 1, wherein said image recording body has the same size as that of an ID card.

7. The method of claim 1, wherein said heating roll comprises silicone rubber.

8. The method of claim 1, wherein said heating roll has a surface temperature of from 180° C. to 250° C.

9. A image recording apparatus comprising a first heating means for imagewise heating a thermal sublimation transfer ink sheet, which is contacted with the image receiving layer of a image receiving sheet, to form a gradation information-containing image on the surface of said image receiving layer, a second heating means for imagewise heating a thermal fusion image transfer sheet or a thermal sublimation image transfer sheet, which is contacted with said image receiving layer, to form a character information-containing image on the surface of said image receiving layer, and a hot stamping means having a heating roll for transferring a transparent protective layer by heating with pressure from a protective layer forming thermal transfer sheet to the surface of said image layer, which is receiving layer carrying said gradation information-containing image and said character information-containing image, so as to cover the whole area of said surface of said image receiving layer, wherein said heating roll has a contacting length longer than the width of said image receiving layer and a peripheral length longer than the length of said image receiving layer.

10. The apparatus of claim 9, wherein said heating roll comprises silicone rubber.

11. The apparatus of claim 9, wherein said heating roll has a surface temperature of from 180° C. to 250° C.

* * * * *